United States Patent [19]

Beauchamp

[11] 4,137,893

[45] Feb. 6, 1979

[54] RIOT CONTROL WEAPON

[75] Inventor: Aaron C. Beauchamp, Moline, Ill.

[73] Assignee: The United States of America as represented by the Secretary of the Army, Washington, D.C.

[21] Appl. No.: 847,362

[22] Filed: Oct. 31, 1977

[51] Int. Cl.[2] ..... F41F 1/04

[52] U.S. Cl. ..... 124/72; 124/51 A

[58] Field of Search ..... 124/51 A, 56, 58, 72, 124/73, 70

[56] References Cited

U.S. PATENT DOCUMENTS

| | | | |
|---|---|---|---|
| 2,251,836 | 8/1941 | Schmidt | 124/58 |
| 2,304,841 | 12/1942 | Mikkelson | 124/73 |
| 2,357,951 | 9/1944 | Hale | 124/72 |
| 2,526,018 | 10/1950 | Foster et al. | 124/73 |
| 3,662,729 | 5/1972 | Henderson | 124/73 |
| 3,911,888 | 10/1975 | Horvath | 124/56 |
| 3,996,916 | 12/1976 | Koehn et al. | 124/72 |

FOREIGN PATENT DOCUMENTS

| | | | |
|---|---|---|---|
| 473731 | 5/1951 | Canada | 124/73 |
| 2602455 | 8/1977 | Fed. Rep. of Germany | 124/70 |
| 348079 | 9/1960 | Switzerland | 124/70 |

*Primary Examiner*—Richard T. Stouffer

*Attorney, Agent, or Firm*—Nathan Edelberg; Robert O. Richardson

[57] ABSTRACT

A riot control weapon using air pressure to eject inexpensive projectiles from its muzzle. Its velocity, range and impact is adjustable by an air regulator between the compressed air supply and the trigger actuated air valve to suit the needs of the situation. The weapon is a rapid fire rifle, wherein the regulator is adapted to provide instantaneous change to the pressure in the barrel of the rifle while the projectiles are being ejected therefrom, thus changing the range of fire of the rifle.

3 Claims, 3 Drawing Figures

RIOT CONTROL WEAPON

GOVERNMENT RIGHTS

The invention described herein may be manufactured and/or used by or for the Government for governmental purposes without the payment of any royalty thereon.

BACKGROUND OF THE INVENTION

This invention relates to automatic rifles for use as riot control weapons. The primary use of weapons of this type is to disperse violent or aggressive crowds without inflicting serious injury.

In the past, conventional weapons have been used which required special ammunition with rubber or plastic projectiles. Such weapons are very expensive, as is the special ammunition required. Grenade launchers and gas grenades have also been used for riot control. These grenades and launchers are also very expensive and require specially trained personnel to set up and fire them. The grenades are usually limited to indoor use only. Since the gas disperses quickly outdoors, the effectiveness is greatly reduced.

The deficiencies of the aforementioned weapons dictate the need for an inexpensive weapon system, capable of firing inexpensive ammunition, while retaining simple operation.

SUMMARY OF THE PRESENT INVENTION

The present invention relates to a compressed air powered, fully automatic riot control rifle. The weapon preferably is mounted on a troop carrying vehicle. In this manner, an air compressor driven by the vehicle's engine may be utilized to supply the compressed air required to operate the weapon. The weapon consists of a first tube or barrel which forms a "Y" with a second tube near the breech end of the barrel. The second tube carries spherical ammunition from a storage canister mounted in the rear of the vehicle. A compressed air tank is connected to the extreme rear end of the barrel by means of a high pressure line. The tank is pressurized by the motor driven compressor as previously stated. A valve actuated by the trigger starts and stops the compressed air flow through the weapon. When the trigger is depressed, compressed air flows through the barrel and across the adjoining ammunition tube. This creates a vacuum in the ammunition tube which draws the spherical ammunition into the barrel. When the projectile enters the barrel the stream of compressed air propels it down the barrel and out the muzzle. This action continues until the trigger is released. This weapon has a very rapid rate of fire, so the weapon may be fired while the vehicle is in motion and retain a close dispersion.

The range and impact velocity may be easily changed by increasing or decreasing the amount of air pressure in the tank. Changing the composition of the projectiles would have a similar effect. For example, a rubber or plastic projectile will have a fairly low impact velocity and limited range. While a plastic projectile with a steel core or a projectile made completely of steel would have an increased impact velocity and extended range.

A weapon such as the one described may be inexpensively manufactured. Since the ammunition is simply a spherical ball, a significant ammunition cost savings could also be had. The rapid fire capability and ease of operation make this weapon ideally suited for use as a riot control weapon.

DETAILED DESCRIPTION OF ILLUSTRATIVE EMBODIMENTS

Figure 1:
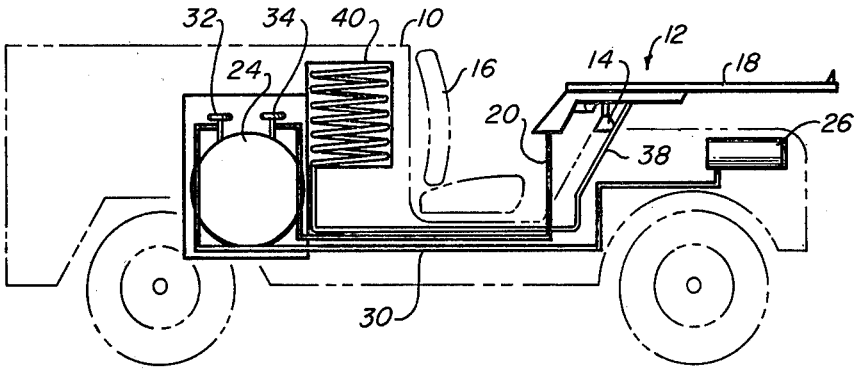
FIG. 1 is an elevational view of the compressed air gun, showing the arrangement of the system components when mounted in a vehicle.
Figure 2:
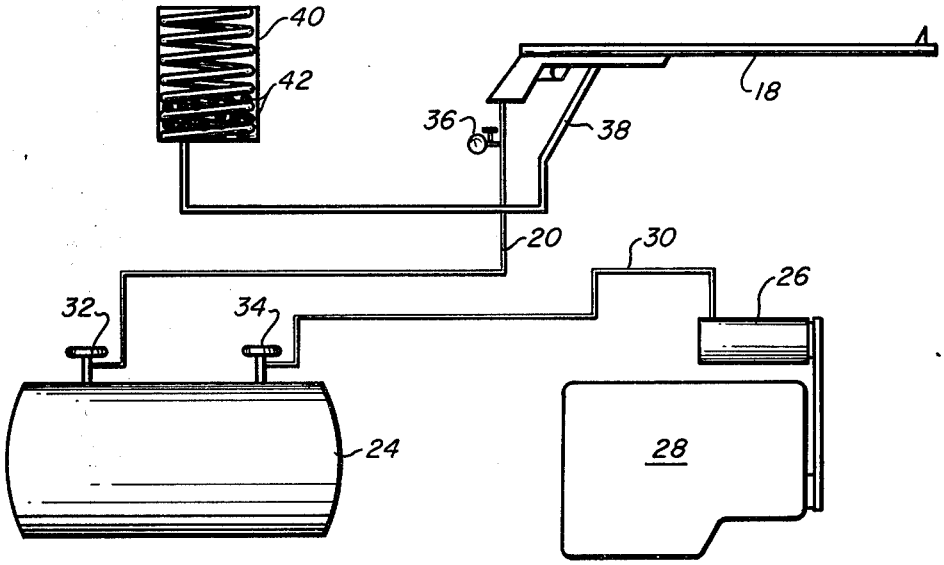
FIG. 2 is an elevational view showing the weapon system components and how they are interconnected and, FIG. 3 is an elevational view in section showing the trigger mechanism and the connection of the ammunition tube with the barrel.
Figure 3:
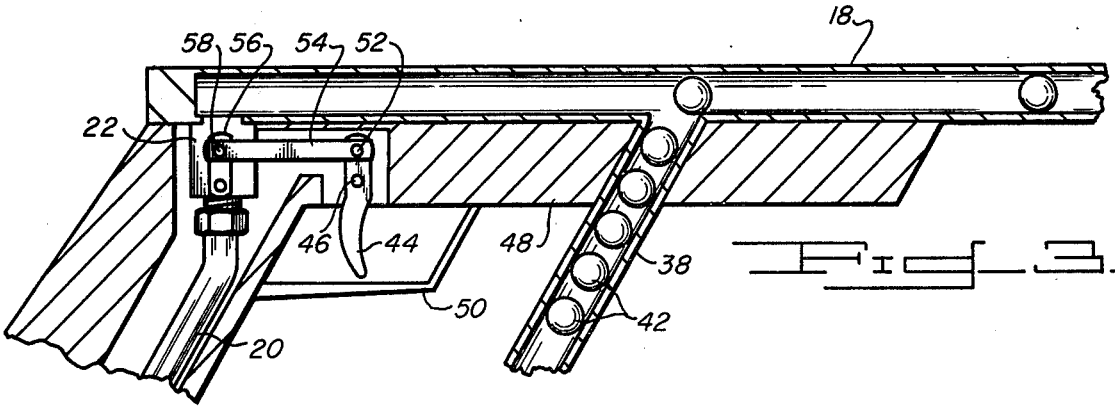

Reference is made to FIG. 1 wherein there is shown, in phantom lines, a truck or troop carrying vehicle 10. A compressed air rifle 12 is pivotally mounted to the vehicle by mount 14. In this manner it is easily accessible from the passenger seat 16 of the vehicle 10. The barrel 18 of the rifle 12 is connected to an air line 20 by means of a trigger actuated valve 22 (FIG. 3). This air line 20 supplies compressed air to the rifle 12 from an air tank 24. The air tank is pressurized by a compressor 26 which is driven by the vehicle's engine 28 (FIG. 2). A second air line 30 connects the compressor 26 and the air tank 24. The air tank 24 is supplied with shut off and pressure relief valves 32, 34. These valves are used to depressurize the system when not in use and prevent excessive pressure build-up in the air tank 24. A pressure regulator 36 (FIG. 2) may be added to control the amount of pressure delivered to the weapon. Range of fire may be controlled in this manner.

Spherical ammunition is fed to the weapon by means of an ammunition tube 38. The tube extends from the weapon barrel 18 to the ammunition storage container 40. The tube is coiled within the container 40 to provide the maximum tube length. In this manner a greater amount of ammunition may be loaded into the tube. The ammunition container also serves to hold additional ammunition 42 (FIG. 2). The ammunition is then readily available when reloading is necessary.

The internal components of the weapon are very simple, as shown in FIG. 3. The trigger 44 is pivotally mounted, by means of a pin 46, to the receiver 48. A conventional trigger guard 50 surrounds the trigger 44 to prevent accidental firing. The trigger is pivotally connected as at 52 to a link 54. The link 54 extends to an actuator 56 on the air valve 22 where it is pivotally attached as at 58. When the trigger is depressed the link 54 is moved forwardly to pivot the actuator 56 on the air valve 22. This action opens the valve 22, allowing compressed air to flow through the barrel 18 and across the ammunition tube 38. The compressed air rushing past the ammunition tube 38 induces a vacuum in the tube. This causes the projectiles 42 to be drawn into the barrel where the compressed air accelerates them down the bore and out the muzzle 18. Automatic firing continues until the trigger is released, cutting off the air flow through the weapon.

The air regulator 36 (FIG. 2) may be adjusted at any time to increase or decrease the range and impact velocity. Using projectiles of different composition will also change the range and impact velocity. For instance soft composition rubber or plastic projectiles will have a fairly limited range and low impact velocity. Steel cored or projectiles made completely of steel however, could become lethal even at extended ranges. The length of the barrel may also be a factor in determining the range and impact velocity. The longer the barrel, the greater the acceleration imparted to the projectiles. Accuracy is also enhanced by using a longer barrel.

This weapon has a very high rate of fire which makes it ideally suited as a vehicle mounted riot control weapon. The high firing rate allows the vehicle to remain in motion when firing and still maintain a close dispersion pattern. The weapon system is also inexpensive to manufacture and operate in comparison with conventional weapons. The ammunition is also very inexpensive compared to explosive type ammunition. The use of air pressure rather than gun powder as propellant eliminates any recoil or muzzle flash. For the same reason, noise is substantially reduced.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A riot control weapon comprising an air pressure source, an air powered rifle connected thereto, and a supply of projectiles continuously feedable to said rifle for ejection therefrom, said rifle including a barrel through which said projectiles are to be ejected, said air pressure source comprising an air compressor connected to an air tank for compressing air therein to a given pressure level, said rifle having a trigger actuated valve, said valve being in an air line, said air line extending between said tank and said barrel, movement of said trigger to a depressed position actuating said valve, which initiates a continuous flow of compressed air through the weapon for ejection of said projectiles, regulator means between said air tank and said valve for controlling ejection pressure and hence range of fire of said rifle, said regulator means being located in said air line and being adjustable to provide a range of pressures to said barrel, which range has an upper limit determined by the given level of pressure of said air tank, said regulator means, when adjusted while said compressed air flows therepast, providing instantaneous change to the pressure in said barrel, said rifle having an ammunition tube connected thereto forwardly of said valve whereby said projectiles may pass into said barrel for ejection therefrom upon trigger actuation of said valve, actuation of said valve initiating said flow of compressed air past said ammunition tube causing said projectiles to be continuously fed into said barrel and sucessively ejected therefrom, said valve being structured so as to be capable of being held open by said trigger, whereby upon a single actuation of said valve, plural projectiles may be ejected from said barrel in quick succession, said ammunition tube terminating in an ammunition storage container whereby said projectiles may be stored in said container and fed into said tube for transmittal to said rifle barrel.

2. A riot control weapon as in claim 1 wherein said weapon is vehicle mounted and said compressor is operated by the engine of said vehicle.

3. A riot control weapon as in claim 1 wherein ejection of one of said projectiles from said barrel creates a reduced pressure in said ammunition tube to draw another one of said projectile into said rifle barrel effecting the continuous feeding of said projectiles into said barrel.

* * * * *

UNITED STATES PATENT AND TRADEMARK OFFICE

CERTIFICATE OF CORRECTION

PATENT NO. : 4,137,893

DATED : February 6, 1979

INVENTOR(S) : Aaron C. Beauchamp

It is certified that error appears in the above-identified patent and that said Letters Patent are hereby corrected as shown below:

Title page, "[73] Assignee: The United States of America as Represented by the Secretary of the Army Washington, D. C."

should be deleted.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*